United States Patent [19]

Hollowell et al.

[11] Patent Number: 5,026,226

[45] Date of Patent: Jun. 25, 1991

[54] MOTION ABSORBING DOCKING ASSEMBLY

[75] Inventors: James A. Hollowell, Northwood; Hal C. Wells, London; Robert W. Robinson, Chessington, all of England

[73] Assignee: Marathon Oil Company, Findlay, Ohio

[21] Appl. No.: 573,956

[22] Filed: Aug. 27, 1990

[30] Foreign Application Priority Data

Dec. 6, 1989 [GB] United Kingdom ..... 8927609

[51] Int. Cl.[5] ..... E02B 17/00

[52] U.S. Cl. ..... 405/211; 267/139; 405/204; 405/224

[58] Field of Search ..... 405/188, 195, 203, 204, 405/211, 212, 224, 227; 114/219; 267/139, 140

[56] References Cited

U.S. PATENT DOCUMENTS

| | | | |
|---|---|---|---|
| 3,945,213 | 3/1976 | Forbes et al. | 405/215 |
| 4,032,126 | 6/1977 | Laughlin | 405/212 X |
| 4,109,476 | 8/1978 | Gracia | 405/169 |
| 4,222,683 | 9/1980 | Schaloske et al. | 405/204 |
| 4,408,930 | 10/1983 | Ninet et al. | 405/209 |
| 4,600,339 | 7/1986 | Castel | 405/211 |
| 4,655,641 | 4/1987 | Weyler | 405/204 |
| 4,662,791 | 5/1987 | Spicer | 405/212 |
| 4,715,310 | 12/1987 | Curtis et al. | 114/220 |
| 4,822,212 | 4/1989 | Hall et al. | 405/227 |
| 4,838,736 | 6/1989 | Moore | 405/224 |
| 4,892,444 | 1/1990 | Moore | 405/195 |
| 4,968,181 | 11/1990 | Goldman | 405/211 |

*Primary Examiner*—David H. Corbin

*Attorney, Agent, or Firm*—Jack L. Hummel; Jack E. Ebel

[57] ABSTRACT

A motion absorbing docking assembly for use in subsea docking operations. A tubular docking pile receives a pile head assembly in which a retractable pile head is positioned. When the pile head is impacted by a docking guide on a jacket being lowered into place, axially spaced shock cells having a common central support member absorb the relative motion between the pile head and the docking pile. This arrangement provides for absorption of twice the distance that each individual shock cell is capable of absorbing by itself.

16 Claims, 2 Drawing Sheets

1/2
FIG. 1
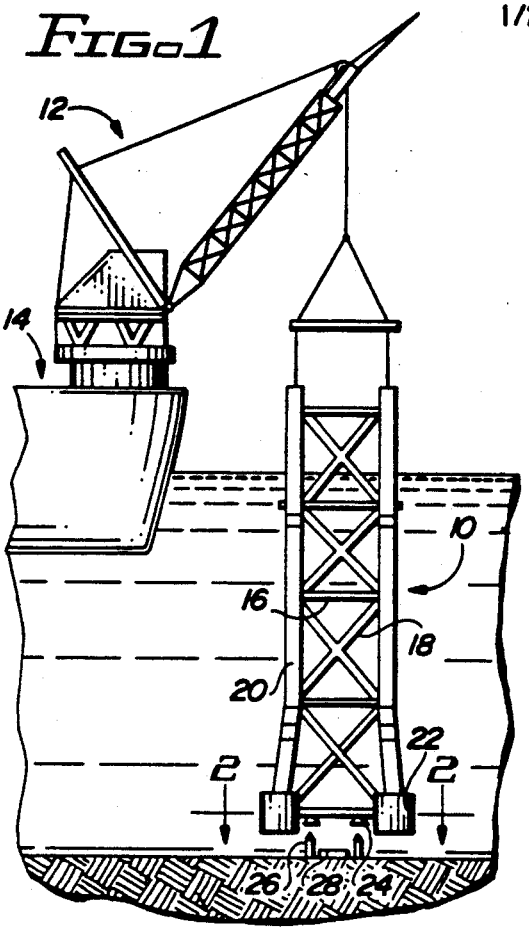
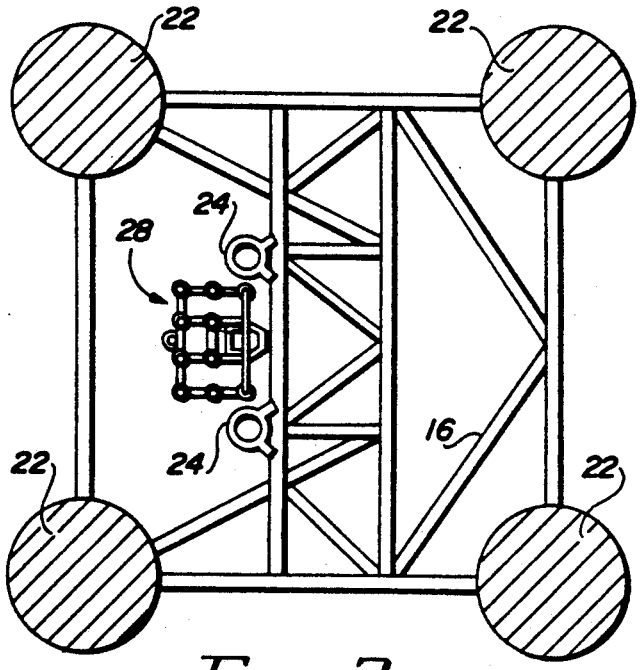
FIG. 2
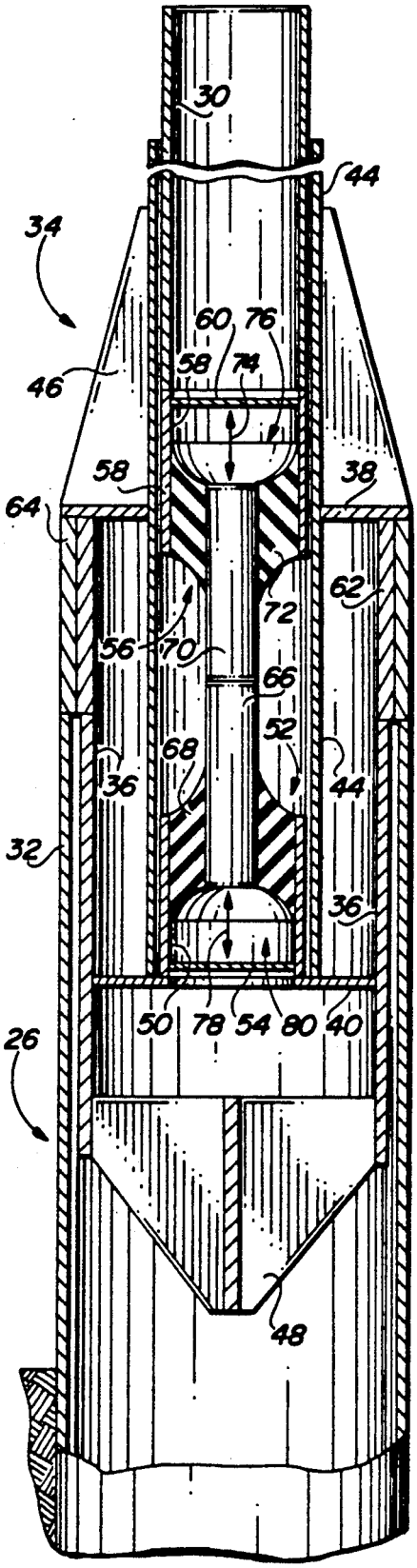
FIG. 4A

2/2

MOTION ABSORBING DOCKING ASSEMBLY

FIELD OF THE INVENTION

This invention relates to apparatus for absorbing relative motion between structural elements. More particularly, it relates to a motion absorbing assembly for use in the docking of a jacket over a subsea docking pile.

BACKGROUND OF THE INVENTION

The use of subsea templates in offshore drilling and production operations is well known. Typically, templates are structurally sound frames incorporating spaced openings corresponding to the wellbores to be drilled. They also normally include means for supporting the well casing and other loads used in subsequent production operations. After a template is positioned on the sea floor over the formation of interest and secured in place by piles, a jacket for supporting the offshore platform is docked over the template and anchored. To carry out the jacket docking operation, docking piles, sometimes known as indexing piles, which previously have been anchored in the sea bed, are engaged by docking guides mounted on the jacket which slide down over the docking piles and guide the jacket into proper alignment.

Due to the force of waves and currents as well as wind loadings, it is very difficult to lower the jacket into place so that the docking guides are directly aligned with the docking piles. Normally, the jacket is misaligned to a degree which causes the docking guides to strike the docking piles before being moved into alignment. Because of the great mass of the jacket the impact can cause damage to the docking piles and the jacket. To prevent this from occurring sliding sleeves are commonly provided on the jacket to take up the impact and absorb the relative motion between the jacket and the docking pile. Typically, the motion absorbing assembly should allow up to a meter of motion with minimal loads into the docking guide. Although such an arrangement reduces the vertical loadings resulting from the impact, it adds considerably to the weight of the jacket. For economic reasons as well as for improving the maneuverability of the jacket during transportation to the site and subsequent lowering to the sea bed, it would be beneficial to reduce the jacket weight as much as practicable. This would have to be accomplished, however, without diminishing the ability to absorb relative vertical motion during a docking operation.

It is recognized that various types of damping or motion absorbing devices have been used in the past in connection with subsea installations, making use of various arrangements of resilient springs and elastomers. None of these designs, however, have shown themselves to be suitable for use in a jacket docking operation.

BRIEF SUMMARY OF THE INVENTION

This invention may be carried out through use of apparatus comprising a docking pile secured to the sea floor, a retractable pile head extending upwardly from the docking pile and a docking guide on the jacket which is adapted to receive the pile head when the jacket is lowered to the sea floor. In a preferred arrangement the docking pile comprises an open-ended tubular section in which a separate pile head assembly fits. A retractable pile head mounted in and extending upwardly from the assembly is maintained in its upwardly extended condition by elastomeric shock cell means mounted in the pile head assembly. The shock cell means is capable of absorbing downward movement of the pile head. The pile head assembly may include a fixed sleeve, in the upper portion of which the pile head is disposed and in the lower portion of which the shock cell means is disposed.

In a preferred arrangement the shock cell means comprises two axially spaced shock cells having a common central support member. Thus the shock cell means comprises an upper elastomeric unit having an outer periphery adhered to a first slidably mounted tubular section and a lower elastomeric unit having an outer periphery adhered to a second tubular section fixed against downward movement. The upper elastomeric unit has an inner periphery adhered to the upper portion of the central support member and lower elastomeric unit having an inner periphery adhered to the lower portion of the support member. Downward movement of the pile head causes downward movement of the first tubular section of the first elastomeric unit, which causes relative movement between the pile head and the central support member. This arrangement allows absorption of twice the motion that each individual shock cell is capable of absorbing alone.

The motion absorbing arrangement of the invention is significantly lighter in weight than the sliding sleeve arrangement of the prior art and yet provides excellent protection against damage to the jacket or the pile head during a docking operation.

The above and other aspects of the invention, as well as other benefits, will readily be apparent from the more detailed description of the preferred embodiment of the invention which follows.

BRIEF DESCRIPTION OF THE DRAWINGS

FIG. 1 is a simplified side elevation of a jacket in the process of being lowered into place over docking piles incorporating the present invention;

FIG. 2 is a transverse sectional view taken along line 2—2 of FIG. 1;

FIG. 4A is an enlarged partial vertical sectional view of a docking assembly of the present invention, showing the assembly with the pile head in fully extended condition;

DETAILED DESCRIPTION OF THE PREFERRED EMBODIMENTS

Figure 3:
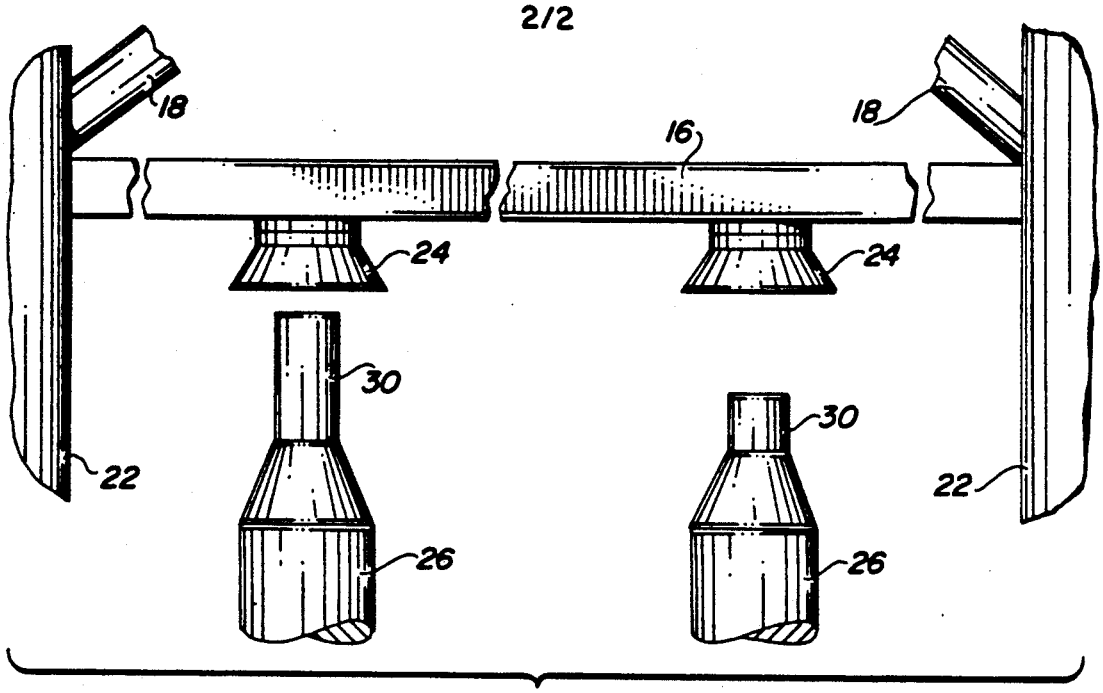
FIG. 3 is a simplified side elevation of the docking piles containing the docking assembly of the present invention, showing the docking guides and a portion of the jacket as the jacket is being lowered into place.

Referring to FIG. 1, a typical jacket 10 is shown in the process of being lowered through the water by a crane 12 mounted on a construction vessel 14. The jacket 10 is comprised of various horizontal and diagonal braces 16 and 18 connecting the legs 20. As is well understood in the industry, after being installed the jacket will support a platform, not shown, above the level of the water from which drilling and production operations will be conducted.

As shown schematically in FIGS. 1 and 2, the bottom portions of the legs 20 are connected to pile clusters 22 which are secured to the sea bottom by piles. Any other suitable arrangement may be used to anchor the jacket to the sea bed, if desired, since the present invention is not concerned with the specific manner in which this is accomplished. The jacket carries two funnel-shaped open-ended docking guides 24 arranged to receive and move down over a portion of the length of two mating docking piles 26. When this is done the jacket will then be in correct alignment with the template 28, which in a previous operation will have been anchored to the sea floor by known means. Similarly, the docking piles 26 previously will have been anchored to the sea floor by suitable conventional means.

Turning to FIG. 3, the jacket is illustrated as having been lowered to a point at which the pile cluster 22 is a short distance from the sea bed, with the docking guides 24 being aligned with the docking piles 26 so that further lowering of the jacket will cause the guide to ride down over the pile heads 30 extending up from the docking piles. Since the gap between the inner diameter of a pile guide and a pile head is small, in the order of half a meter or so, it can be seen that if the docking guides and pile heads are slightly misaligned the docking guides will strike the pile heads as the jacket is lowered. This is what normally occurs, given the large size of the jacket, the small target area toward which it is being aimed and the difficult wave and current conditions of the water. When this happens the pile head is struck with great impact, even at slow lowering speeds, due to the great mass of the moving jacket. Unless the vertical loadings caused by the impacting of the docking guide and the pile head are reduced, damage to the jacket or the docking piles and pile heads can result. Note that two docking piles 26 and docking guides 24 are illustrated in order to properly align the jacket in all directions. Since it is difficult to align both guides with both piles at the same time due to lateral movement of the jacket caused by the water and the tendency of the jacket to swing from the crane cables, the docking piles preferably are made of different heights, as shown in FIG. 3. This allows one of the guides to be mated with the higher docking pile first, shown at the left of FIG. 3, followed by the mating of the other guide with the shorter docking pile. Although this is the preferred manner of docking the jacket the present invention does not preclude other docking methods from being used.

Referring to FIG. 4A, the docking pile 26 comprises a tubular section or housing 32 anchored in the sea bed. The tubular section 32 extends above the sea bed a distance which provides enough room to receive the lower portion of a pile head insert 34. The insert comprises a tubular section 36 which is slidably received in the tubular section 32. An annular plate 38 is connected to the upper end of the tubular section 36 and extends for a short distance radially beyond the circumference of the tubular section. Another annular plate 40 is connected to the inner surface of the tubular section 36 at a point spaced from the lower end of the section.

Extending through the central opening of annular plate 38 is tubular section 44, the bottom end of which is supported by and is connected to the annular plate 40. The tubular section 44 is strengthened by stiffener plates 46 which extend radially outwardly from the section 44 and are connected to the upper surface of the annular plate 38. The lower end of the tubular section 36 is also reinforced by stiffener plates 48 connected to the inner surface of the lower portion of the section 36. The stiffener plates 48 extend down from the end of the tubular section 36 and are tapered toward the central axis of the assembly whereby they also function as a guide for the pile head assembly when it is introduced into the docking pile.

Supported on the annular plate 40 radially inwardly of the cylinder 44 is the outer tubular section 50 of a shock cell unit 52. The bottom end portion of the tubular section 50 is connected to a bottom plate 54. Upwardly spaced from the unit 52 is a similar shock cell unit 56 which has an outer tubular section 58 slidably mounted in the cylinder 44. The top end portion of the tubular section 58 is connected to a top plate 60. Also slidably mounted in the cylinder 44 above the outer tubular section 58 of the shock cell unit 56 is tubular section 30 which functions as the pile head.

It will be noted that the tubular section 36 of the pile head assembly 26 is shown spaced from the tubular docking pile 32 for ease of introducing and sliding the assembly into the docking pile. Further, the upper portion of the tubular section 36 may be comprised of a separate short thicker tubular section 62 which contacts the inner surface of the docking pile 32 to provide more stability to the arrangement. The upper portion of the docking pile 32 is also shown as comprising a separate thicker section 64, which facilitates this arrangement. The section 64 in this instance may comprise the driving head used to anchor the docking pile in the sea bed. Although the plate 38 is shown as contacting the upper ends of both the sections 62 and 64, it will be understood that the section 64 may instead be spaced from the plate 38 with stiffener plates or strips provided between the plate 38 and the section 64 in order to ensure structural continuity between the section 64 and the plate 38.

Still referring to FIG. 4A, the shock cell unit 52 includes in addition to the outer tubular section 50 an axially located cylindrical support member 66 and an elastomeric ring or unit 68 bonded to the section 50 and the cylindrical member 66 in the usual manner. Similarly, the shock cell unit 56 includes in addition to outer tubular section 58 an axially located cylindrical support member 70 and an elastomeric ring or unit 72 bonded to the section 58 and the cylindrical member 70. Each of the shock cell units is conventional in design but they are arranged so that the lower end of axial support member 70 is connected, as by welding, to the upper end of axial support member 66. The outer tubular sections 50 and 58 are thus capable of relative axial movement toward each other.

In the condition shown in FIG. 4A, which depicts the fully extended condition of the pile head 30, the lower end of the pile head 30 is in contact with the outer tubular section 58 of the shock cell unit 56. The upper end of the support member 70 is spaced from the upper plate 60 a distance represented by the arrow 74, thereby forming a cavity 76 defined by the plate 60, the upper end of the support member 70, portions of the tubular section 58 and the upper surface of the elastomeric unit 72. The lower end of the support member 66 is spaced from the lower plate 54 a distance represented by the arrow 78, thereby forming a cavity 80 defined by the plate 54, the lower end of the support member 66, portions of the tubular section 50 and the lower surface of the elastomeric unit 68. The connected support members 66 and 70, being connected only to the elastomeric units 68 and 72, are in effect in a floating arrangement capable of movement relative to the end plates 60 and 54.

Figure 4B:
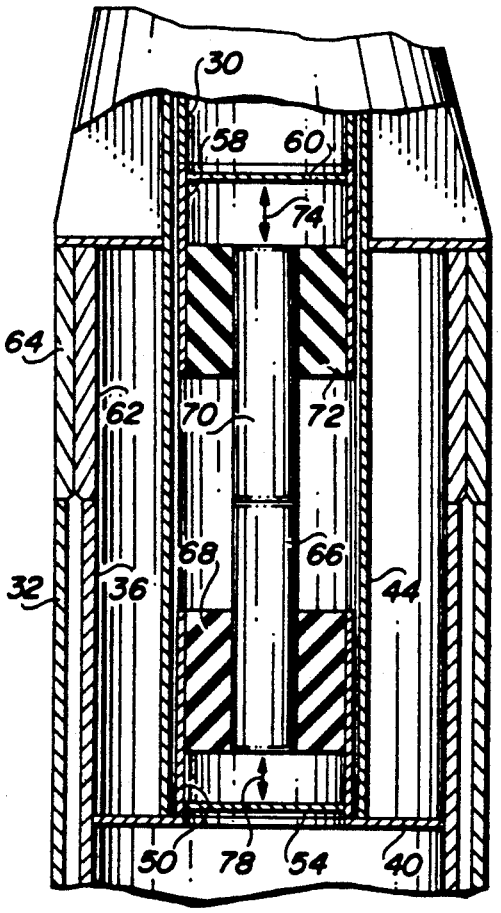
FIG. 4B is a vertical sectional view similar to that of FIG. 4A, but showing the assembly with the pile head at an intermediate stage of retraction.

When a docking guide strikes the pile head, the impact causes the pile head 30 to be pushed down within the sleeve or tubular section 44. When this occurs the lower end of the tubular pile head 30 pushes against the upper end of the tubular section 58 of shock cell 56. This downward force tends to move the tubular section 58 and the central support members 66 and 70 in a downward direction. Movement of the support members is resisted, however, by the connection between the elastomeric unit 68 and the tubular section 50 and by the engagement of the lower end of tubular section 50 with the plate 40. This resistance tends to move the support members 66 and 70 up into the cavity 76, which, however, is resisted by the connection between the elastomeric unit 72 and the tubular section 58 and by the engagement of the upper end of the tubular section 58 with the bottom end of pile head 30. The elastomeric resistance forces take up or absorb the energy of the moving pile head. As the pile head moves down against this resistance, relative movement between the elements results in the ends of the support members 66 and 70 moving closer to the plates 54 and 60 which form their respective cavity end walls. The dimensions represented by the arrows 74 and 78 are thus both reduced and the size of the cavities 76 and 80 is diminished. FIG. 4B illustrates the effects of this relative movement, showing the various elements in an intermediate condition as the pile head is being retracted in response to a downward force on the pile head.

Figure 4C:
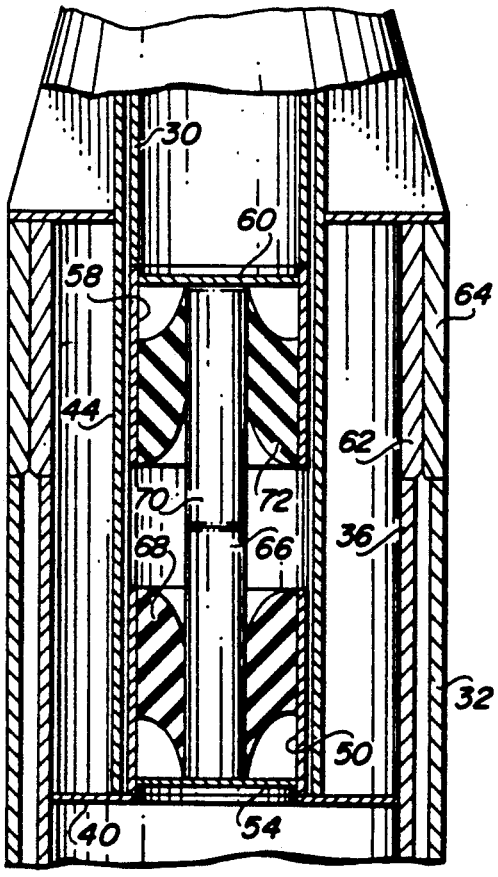
FIG. 4C is a vertical sectional view similar to that of FIG. 4B, but showing the assembly with the pile head fully retracted.

If the downward force on the pile head is sufficient to drive it to the fully retracted position shown in FIG. 4C, the upper end of the support member 70 will be in contact with the plate 60 and the lower end of the support member 66 will be in contact with the plate 54. The relative conditions of both elastomeric units 68 and 72 are now the reverse of their starting conditions. The outer periphery of the upper elastomeric unit 72 is now lower than its inner periphery instead of higher, and the outer periphery of the lower elastomeric unit 68 is now higher than its inner periphery instead of higher.

If desired, the tubular sections 50 and 58 of the shock cells can be of such length that when the pile head is fully retracted the bottom of the section 58 will contact the top of section 50. This would provide a further stop means to halt movement of the pile head when the elastomeric units 68 and 72 have reached the limit of their motion absorbing capability.

It will be appreciated that if a single shock cell were employed it would have to be capable of absorbing up to a meter of motion itself, which would require a redesign of existing available shock cells. In accordance with the described preferred embodiment, however, each shock cell is required only to absorb a half meter of motion, which is made possible by the dual cell arrangement which provides the assembly with twice the motion absorption capability than that of each individual cell.

The shock cell units contemplated for use in the invention are those currently available from shock cell manufacturers which are capable of taking up a half meter of motion under the loading contemplated in an undersea docking operation. There is thus no need for the development of individual shock cell designs capable of taking up a full meter of motion. More detailed information pertaining to available shock cells may be obtained from manufacturers of shock cells such as Marine Rubber Incorporated of Humble, Tex., USA, Regal Marine Products of Houston, Tex., USA and Teledyne Monarch Rubber of Hartville, Ohio, USA.

It will be understood by those skilled in the art that although specific connecting means between the various elements illustrated in the drawings have not been shown, commonly employed bolting connections and welds may be utilized as required.

It will now be appreciated that the invention provides a novel, compact, efficient means of absorbing vertical motion in a subsea installation which is not only relatively inexpensive but is considerably lighter in weight than the prior art sliding sleeve arrangement. It employs readily available components in an arrangement which does not initially incorporate them in the docking pile but permits them to be added after the docking pile has been driven into the sea bed simply by inserting a pile head assembly into the docking pile.

It should be apparent, however, that the invention is not necessarily limited to all the specific details described in connection with the preferred embodiments, but that changes to certain features which do not alter the overall basic function and concept of the invention may be made without departing from the spirit and scope of the invention, as defined in the appended claims.

What is claimed is:

1. Apparatus for use in docking a jacket over a subsea template, comprising:
   - a docking pile secured to the sea floor, the docking pile having an upper open-ended tubular portion;
   - a separate pile head assembly mounted in the upper portion of the docking pile;
   - a retractable pile head mounted in and extending upwardly from the pile head assembly;
   - the pile head being maintained in its upwardly extended condition by elastomeric shock cell means mounted in the pile head assembly; and
   - the elastomeric shock cell means being capable of absorbing downward movement of the pile head caused by contact with the jacket as the jacket is lowered to the sea floor.

2. The apparatus of claim 1, wherein the pile head assembly includes a tubular portion fitting into the open-ended tubular portion of the docking pile, and stop means on the pile head assembly for engaging the docking pile to limit the extent of movement of the pile head assembly into the docking pile.

3. The apparatus of claim 1, wherein the pile head assembly includes a fixed sleeve extending above the docking pile, the elastomeric shock cell means being mounted in a lower portion of the fixed sleeve and the pile head being mounted in an upper portion of the fixed sleeve, the lower end of the pile head engaging the shock cell means.

4. The apparatus of claim 3, wherein the elastomeric shock cell means comprises an outer tubular section adhered to the outer periphery of an elastomeric unit, the outer tubular section being slidably mounted in the fixed sleeve of the pile head assembly.

5. The apparatus of claim 4, wherein the elastomeric shock cell means comprises a second outer tubular section adhered to the outer periphery of a second elastomeric unit mounted in the fixed sleeve of the pile head assembly below the slidably mounted outer tubular section, and an elongated support member adhered to the inner peripheries of both elastomeric units.

6. The apparatus of claim 4, including a plurality of docking piles and associated pile heads, each docking pile containing elastomeric shock cell means for absorbing downward movement of the pile head.

7. A motion absorbing assembly for use in the docking of a jacket over a subsea docking pile, comprising:

a main body having a lower portion adapted to fit into an open upper end of the docking pile;

the main body including an upwardly extending sleeve;

a retractable pile head having a lower portion situated in the sleeve and an upper portion extending upwardly therefrom; and elastomeric shock cell means in the sleeve below the retractable pile head;

the shock cell means comprising an upper elastomeric unit having an outer periphery adhered to a first slidably mounted tubular section and a lower elastomeric unit having an outer periphery adhered to a second tubular section fixed against downward movement;

the upper elastomeric unit having an inner periphery adhered to the upper portion of a support member and the lower elastomeric unit having an inner periphery adhered to the lower portion of the support member;

the pile head and the first tubular section being mounted so that downward movement of the pile head causes downward movement of the first tubular section.

8. The assembly of claim 7, wherein the bottom of the pile head is engaged with the top of the first tubular section of the shock cell means.

9. The assembly of claim 7, wherein the second tubular section is fixed against downward movement by stop means connected to the assembly.

10. The assembly of claim 7, including a first end wall on the first tubular section upwardly spaced from the support member and a second end wall on the second tubular section downwardly spaced from the support member, the spacing of the first and second end walls from the support member being substantially the same.

11. The assembly of claim 7, wherein the outer periphery of the upper elastomeric unit is located above the inner periphery thereof and the outer periphery of the lower elastomeric unit is located below the inner periphery thereof when the pile head is fully extended.

12. The assembly of claim 11, wherein the outer periphery of the upper elastomeric unit is located below the inner periphery thereof and the outer periphery of the lower elastomeric unit is located above the inner periphery thereof when the pile head is fully retracted.

13. In apparatus containing an elongated structural member subject to axial loading and capable of axial movement, a motion absorbing arrangement, comprising:

a sleeve for receiving a portion of the elongated structural member; and elastomeric shock cell means in the sleeve between the elongated structural member and the end of the sleeve remote therefrom;

the shock cell means comprising a first elastomeric unit having an outer periphery adhered to a first slidably mounted tubular section adjacent the elongated structural member and a second elastomeric unit having an outer periphery adhered to a second tubular section fixed against movement away from the elongated structural member;

the first elastomeric unit having an inner periphery adhered to an end portion of a support member and the second elastomeric unit having an inner periphery adhered to the opposite end portion of the support member;

the elongated structural member and the first tubular section being mounted so that movement of the elongated structural member in response to an axial force causes axial movement of the first tubular section.

14. The motion absorbing arrangement of claim 13, including a first end wall on the first tubular section spaced from the support member and a second end wall on the second tubular section spaced from the support member, the spacing of the first and second end walls from the support member being substantially the same.

15. The motion absorbing arrangement of claim 13, wherein the outer periphery of the first elastomeric unit is closer to the elongated structural member than the inner periphery thereof and the outer periphery of the lower elastomeric unit is farther from the elongated structural member than the inner periphery thereof prior to axial movement of the elongated structural member.

16. The assembly of claim 15, wherein the outer periphery of the first elastomeric unit is farther from the elongated structural member than inner periphery thereof and the outer periphery of the second elastomeric unit is closer to the elongated structural member than the inner periphery thereof after the elongated structural member has completed its maximum axial movement.

* * * * *